US008471624B2

(12) United States Patent
Bonsels et al.

(10) Patent No.: US 8,471,624 B2
(45) Date of Patent: Jun. 25, 2013

(54) METHOD FOR CONTROLLING THE SUPPLY VOLTAGE FOR AN INTEGRATED CIRCUIT AND AN APPARATUS WITH A VOLTAGE REGULATION MODULE AND AN INTEGRATED CIRCUIT

(75) Inventors: Stefan Bonsels, Stuttgart (DE); Cedric Lichtenau, Stuttgart (DE); Antje Mueller, Boeblingen (DE); Thomas Pflueger, Leinfelden (DE); Friedrich Schroeder, Stuttgart (DE)

(73) Assignee: International Business Machines Corporation, Armonk, NY (US)

( * ) Notice: Subject to any disclaimer, the term of this patent is extended or adjusted under 35 U.S.C. 154(b) by 101 days.

(21) Appl. No.: 13/037,343

(22) Filed: Feb. 28, 2011

(65) Prior Publication Data

US 2012/0218031 A1 Aug. 30, 2012
US 2013/0113545 A9 May 9, 2013

Related U.S. Application Data

(63) Continuation of application No. 12/174,902, filed on Jul. 17, 2008, now abandoned.

(51) Int. Cl.
*G05F 3/02* (2006.01)

(52) U.S. Cl.
USPC ..... 327/538; 327/540; 327/563

(58) Field of Classification Search
USPC ..... 327/538, 540, 543, 561, 563; 307/36–40; 323/234, 265–268, 270, 272, 311
See application file for complete search history.

(56) References Cited

U.S. PATENT DOCUMENTS

| | | | | |
|---|---|---|---|---|
| 3,747,008 | A * | 7/1973 | Zaretsky | 330/110 |
| 6,501,251 | B1 | 12/2002 | Mosley et al. | |
| 6,507,223 | B2 * | 1/2003 | Felder | 327/77 |
| 6,650,173 | B1 * | 11/2003 | Khouri et al. | 327/538 |
| 7,751,158 | B2 | 7/2010 | Qian et al. | |
| 2001/0019288 | A1 * | 9/2001 | Wada et al. | 327/561 |
| 2003/0151450 | A1 * | 8/2003 | Nguyen et al. | 327/540 |
| 2007/0262757 | A1 * | 11/2007 | Kawagoshi | 323/265 |
| 2010/0013446 | A1 * | 1/2010 | Bonsels et al. | 323/234 |

* cited by examiner

*Primary Examiner* — Lincoln Donovan
*Assistant Examiner* — Jung H Kim
(74) *Attorney, Agent, or Firm* — Scully, Scott, Murphy & Presser, P.C.; Joseph P. Abate, Esq.

(57) ABSTRACT

The present invention relates to a method for controlling the supply voltage for an integrated circuit, which is connected to a voltage regulation module via a sense line, a voltage supply line and a bus wherein the supply voltage is provided by the voltage regulation module (10) via the voltage supply line. The supply voltage is composed of a reference voltage and a number of additional voltage levels. The reference voltage is defined by a voltage source and controlled by the integrated circuit via the bus, and the number of additional voltage levels is determined by the integrated circuit and send to the voltage regulation module via the sense line. Further the present invention relates to a corresponding apparatus with a voltage regulation module and an integrated circuit.

19 Claims, 3 Drawing Sheets

METHOD FOR CONTROLLING THE SUPPLY VOLTAGE FOR AN INTEGRATED CIRCUIT AND AN APPARATUS WITH A VOLTAGE REGULATION MODULE AND AN INTEGRATED CIRCUIT

CROSS-REFERENCE TO RELATED APPLICATIONS

This application is a continuation of U.S. patent application Ser. No. 12/174,902, filed Jul. 17, 2008, now abandoned and claims the benefit under 35 U.S.C. §120 of U.S. patent application Ser. No. 12/174,902.

BACKGROUND OF THE INVENTION

1. Field of the Invention

The present invention relates to a method for controlling the supply voltage for an integrated circuit, which is connected to a voltage regulation module. Further, the present invention relates to an apparatus with a voltage regulation module and an integrated circuit.

2. Description of the Related Art

A voltage regulator module is provided to supply one or more integrated circuits with a varying voltage. In particular, the voltage regulator module is provided to supply a microprocessor with voltage. The voltage regulator module is further provided to vary the voltage for the integrated circuit. Different operation modes of the integrated circuit require various voltages. The voltage regulator module is formed as a single semiconductor chip. The integrated circuit is also formed as a single semiconductor chip. Usually, the voltage regulator module and the integrated circuit are on the same board.

A known example for the integrated circuit 20 with the voltage regulator module 10 is shown in FIG. 5. The voltage regulation module 10 is formed as a single semiconductor chip. The integrated circuit 20 is also formed as a single semiconductor chip. The voltage regulation module 10 comprises an operational amplifier 12 and a voltage source 14. The operational amplifier 12 provides the supply voltage $V_{dd}$ for the integrated circuit 20.

The integrated circuit 20 comprises the voltage mesh 22. The voltage mesh 22 receives the supply voltage $V_{dd}$ and provides a plurality of different voltages on the integrated circuit 20. The voltage mesh 22 is directly connected to the negative input terminal of the operation amplifier 12 via a sense line 18. The sense line 18 acts as a feedback line from the integrated circuit 20 to the voltage regulator module 10 in order to keep the voltage stable on the integrated circuit 20.

The changing of the voltage on the integrated circuit 20 should be done as fast as possible.

In addition, in order to vary the voltage, it is advantageous to track both cycle time and voltage on the integrated circuit 20 with respect to the workload. The variation of the cycle time is performed by an additional component, e.g. serial data port of an I2C (Inter-Integrated Circuit) bus, not shown in FIG. 5.

Conventional voltage regulator modules are programmed by buses having a bandwidth of about 1 kbit/s to 100 kbit/s. For example, the voltage regulator modules are programmed by an I2C bus or an SMBus (System Management Bus). The I2C bus is operating at a frequency of about 1 MHz. This is relative relatively slow compared with the microprocessor or other integrated circuits.

To set new voltages about 20 bits are used. Thus, there are required about 20 μs to 200 μs in order to program new voltages on the voltage regulator module 10. Compared to the cycle time of a typical microprocessor about 60,000 cycles occur on the chip until the new voltage is set at the voltage regulator module 10.

OBJECT OF THE INVENTION

It is an object of the present invention to provide an improved method for controlling the supply voltage for an integrated circuit and an improved apparatus with a voltage regulation module and an integrated circuit.

SUMMARY OF THE INVENTION

The above object is achieved by a method as laid out in the independent claims. Further advantageous embodiments of the present invention are described in the dependent claims and are taught in the description below.

The core idea of the invention is the control of the voltage regulator module primary by a bus and secondary by a sense line. A basic voltage level is controlled and/or programmed by the bus, e.g. by an I2C bus or a SMBus. The sense line is manipulated by a logic circuit on the integrated circuit at the frequency of said voltage variation on an integrated circuit. The sense line is used to manipulate the feedback signal starting from the basic voltage level.

The integrated circuit includes a controllable circuit between the voltage supply and the ground in order to provide a suitable voltage for the sense line. The controllable circuit may be realized as a programmable voltage divider. The voltage divider is built up by usual electronic elements, such as transistors and/or resistor elements.

The integrated circuit may include a control loop for detecting and controlling the voltage on the integrated circuit. The control loop may be provided for controlling the voltage divider.

The present invention allows a safe power supply by controlling the voltage and adjusting it to the current demand on the integrated circuit.

The supply voltage for the integrated circuit can be adapted very fast to the current operation mode of the integrated circuit. This allows higher clock frequencies on the integrated circuit.

The integrated circuit may be clocked by a higher frequency as the allowed frequency for a longer time as in the prior art.

BRIEF DESCRIPTION OF THE DRAWINGS

The above as well as additional objectives, features and advantages of the present invention will be apparent in the following detailed written description.

The novel and inventive features believed characteristics of the invention are set forth in the appended claims. The invention itself, their preferred embodiments and advantages thereof will be best understood by reference to the following detailed description of preferred embodiments in conjunction with the accompanied drawings, wherein:

DETAILED DESCRIPTION OF THE INVENTION

Figure 1:
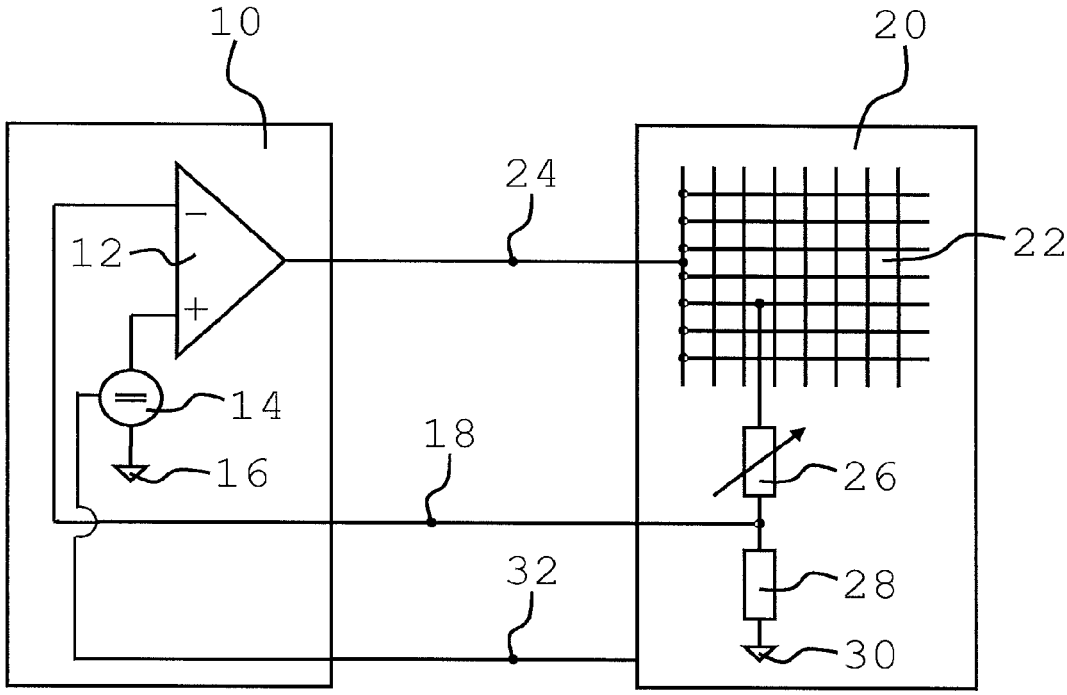
FIG. 1 illustrates a schematic diagram of a voltage regulation module and an integrated circuit according to a preferred embodiment of the present invention.

FIG. 1 illustrates a schematic diagram of a voltage regulation module 10 and an integrated circuit 20 according to a preferred embodiment of the present invention. The voltage regulation module 10 is formed as a single semiconductor chip. The integrated circuit 20 is also formed as a single semiconductor chip. For example, the integrated circuit 20 is a microprocessor. In particular, the voltage regulation module 10 and the integrated circuit 20 are arranged on the same board.

The voltage regulation module 10 comprises an operational amplifier 12 and a voltage source 14. The one terminal of the voltage source 14 is connected to the positive input terminal of the operational amplifier 12. The other terminal of the voltage source 14 is connected to a ground terminal 16 of the voltage regulation module 10. The negative input terminal of the operational amplifier 12 is connected to a sense line 18. The output terminal of the operational amplifier 12 provides a supply voltage $V_{dd}$ for the integrated circuit 20.

The integrated circuit 20 comprises a voltage mesh 22. The voltage mesh 22 is connected to the output terminal of the operational amplifier 12 via a voltage supply line 24. The voltage mesh 22 receives the supply voltage $V_{dd}$ and provides a plurality of different voltages on the integrated circuit 20. The voltage mesh 22 is connected to a variable resistor element 26. The variable resistor element 26 is connected to a constant resistor element 28. The constant resistor element 28 is connected to a ground terminal 30 of the integrated circuit 20. Thus, the variable resistor element 26 and the constant resistor element 28 form a series between the voltage mesh 22 and the ground terminal 30 of the integrated circuit 20. The coupling point between the variable resistor element 26 and the constant resistor element 28 is connected to the negative input terminal of the operation amplifier 12 via the sense line 18.

The variable resistor element 26 is controlled by the integrated circuit 20. In particular, the variable resistor element 26 is programmable by the integrated circuit 20. In a special embodiment, the variable resistor element 26 may be realized by a resistor network, which is programmable by a microprocessor.

The voltage regulation module 10 is controlled by the integrated circuit 20 via the bus 32 and the sense line 18. The bus 32 controls the voltage source 14 and sets a reference voltage value $V_{ref}$. The bus 32 may be realized as an I2C bus or a SMBus, for example. The reference voltage value $V_{ref}$ forms a basic voltage level. The feedback signal on the sense line 18 is manipulated by the logic on the integrated circuit 20. Starting from the reference voltage value $V_{ref}$ the feedback signal on the sense line 18 provides additional voltage levels 34. The supply voltage $V_{dd}$ consists of the reference voltage value $V_{ref}$ and the additional voltage levels 34.

The invention allows controlling the supply voltage $V_{dd}$ and adjusting it to the current demand of the integrated circuit 20.

Figure 2:
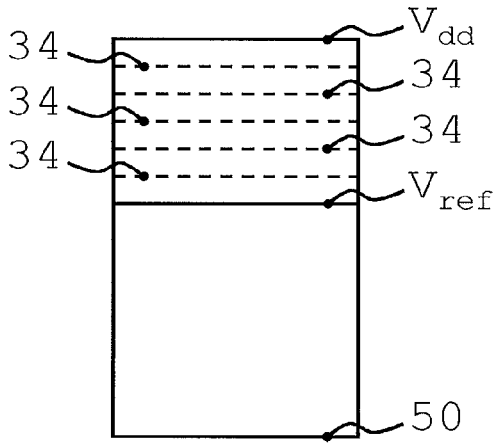
FIG. 2 illustrates a schematic diagram of the voltage values according to the preferred embodiment of the present invention.

FIG. 2 illustrates the composition of the supply voltage $V_{dd}$ provided by the voltage regulation module 10. The single voltage levels are represented by horizontal lines. The base line represents the potential 50 of the ground terminal 16. The supply voltage $V_{dd}$ includes the reference voltage value $V_{ref}$ and the activated additional voltage levels 34. The reference voltage value $V_{ref}$ is provided by the voltage source 14. In this example a R2R network is used to manipulate the sense line 18. Thus, the voltage levels 34 have equidistant voltage steps. This guarantees uniform voltage ramps. Further, the R2R network has the capability to solve power-on-problems by tightening control of the supply voltage $V_{dd}$. Else the power-on-problem would imply undefined logical states.

Figure 3:
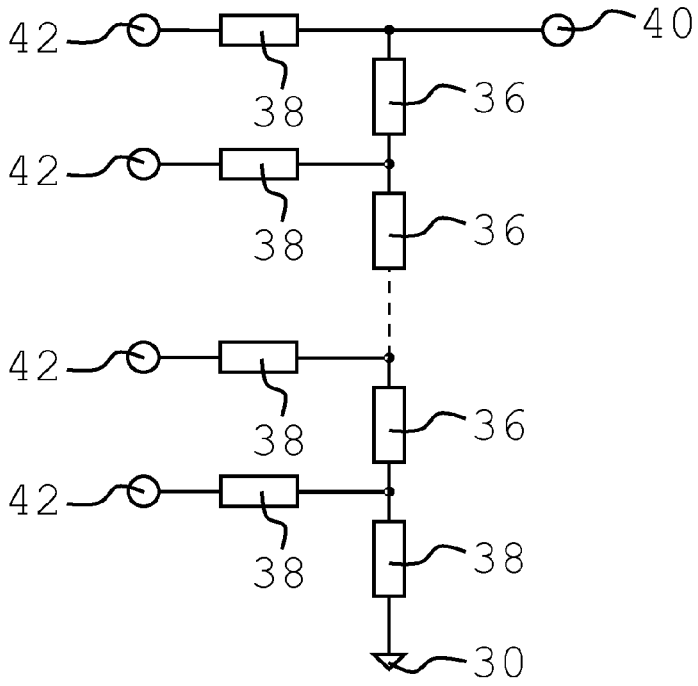
FIG. 3 illustrates a schematic diagram of a resistor network according to the preferred embodiment of the present invention.

FIG. 3 illustrates a schematic diagram of the R2R network. The R2R network is a possible implementation of the variable resistor element 26 and the constant resistor element 28 in FIG. 1. The R2R network includes a plurality of first resistor elements 36 and a plurality of second resistor elements 38. All first resistor elements 36 and one second resistor element 38 are serially interconnected between an output terminal 40 and the ground terminal 30. Each of the other second resistor elements 38 is connected between a coupling point of the series and one of a plurality of input terminals 42, respectively. The R2R network provides voltage levels 34 with equidistant voltage steps.

Figure 4:
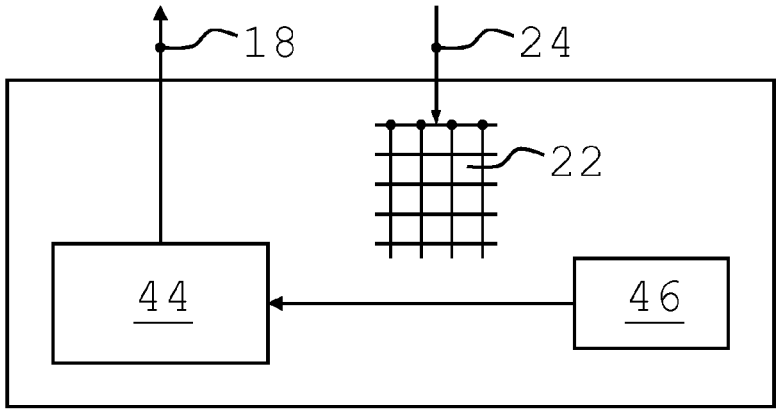
FIG. 4 illustrates a schematic diagram of the integrated circuit according to the preferred embodiment of the present invention.

FIG. 4 illustrates a schematic diagram of an example for the integrated circuit 20. Said integrated circuit 20 includes an R2R network 44, a control loop 46 and the voltage mesh 22. The voltage mesh 22 is connected to the output terminal of the operation amplifier 12 via the voltage supply line 24. The R2R network 44 is connected to the negative input terminal of the operation amplifier 12 via the sense line 18. The control loop 46 is connected to the input terminals 42 of the R2R network 44. The control loop 46 detects the voltage on the integrated circuit 20 and activates one of a plurality of voltage dividers. For example, the R2R network may be a seven-bit R2R network.

Figure 5:
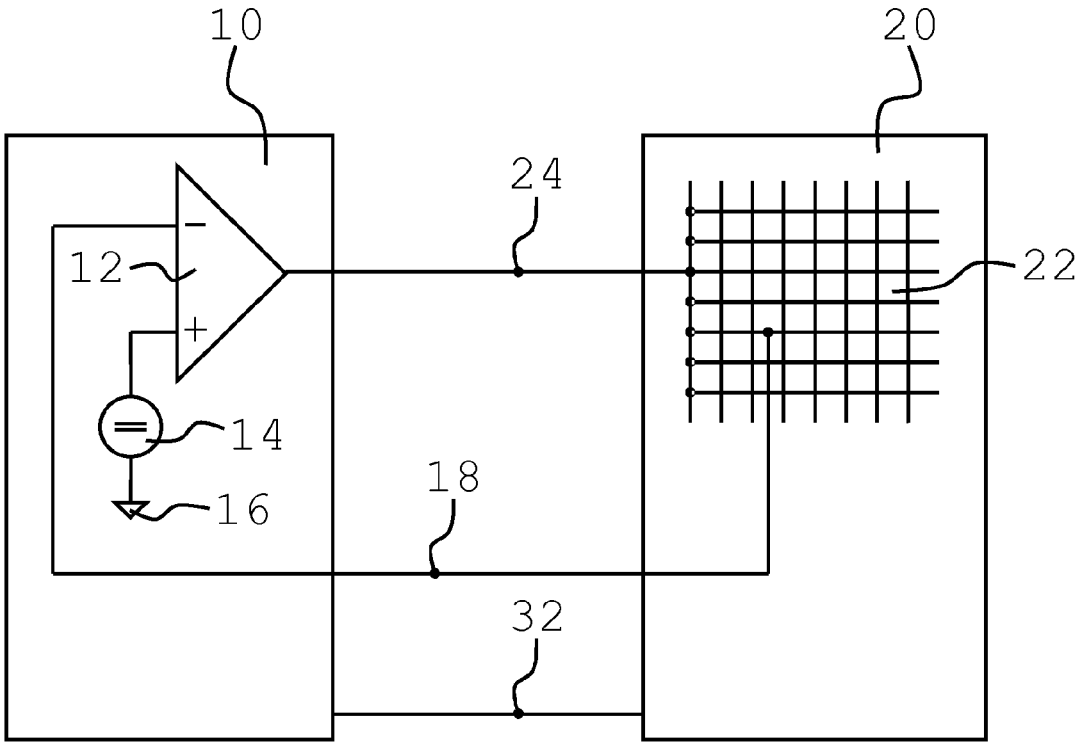
FIG. 5 (Prior Art)
FIG. 5 illustrates a schematic diagram of the voltage regulation module and the integrated circuit according to the prior art.

FIG. 5 illustrates a schematic diagram of the voltage regulation module 10 and the integrated circuit 20 according to the prior art. The voltage regulation module 10 is formed as a single semiconductor chip. The integrated circuit 20 is also formed as a single semiconductor chip. Usually, the voltage regulation module 10 and the integrated circuit 20 are arranged on the same board.

The voltage regulation module 10 comprises the operational amplifier 12 and the voltage source 14. The one terminal of the voltage source 14 is connected to the positive input terminal of the operational amplifier 12. The other terminal of the voltage source 14 is connected to the ground terminal 16 of the voltage regulation module 10. The negative input terminal of the operational amplifier 12 is connected to the sense line 18. The output terminal of the operational amplifier 12 provides the supply voltage $V_{dd}$ for the integrated circuit 20.

The integrated circuit 20 comprises the voltage mesh 22. The voltage mesh 22 is connected to the output terminal of the operational amplifier 12 via the voltage supply line 24. The voltage mesh 22 receives the supply voltage $V_{dd}$ and provides a plurality of different voltages on the integrated circuit 20. The voltage mesh 22 is directly connected to the negative input terminal of the operation amplifier 12 via the sense line 18.

The present invention can also be embedded in a computer program product, which comprises all the features enabling the implementation of the methods described herein. Further, when loaded in computer system, said computer program product is able to carry out these methods.

Although illustrative embodiments of the present invention have been described herein with reference to the accompanying drawings, it is to be understood that the present invention is not limited to those precise embodiments, and that various other changes and modifications may be performed therein by one skilled in the art without departing from the scope or spirit of the invention. All such changes and modifications are intended to be included within the scope of the invention as defined by the appended claims.

What is claimed is:

1. A method for controlling a supply voltage for an integrated circuit by using a voltage regulation module, comprising:

connecting said voltage regulation module to said integrated circuit via a sense line, a voltage supply line and a bus;

wherein said supply voltage is provided by the voltage regulation module via said voltage supply line;

wherein said supply voltage comprises a reference voltage and one of a plurality of additional voltage levels, said reference voltage being provided by a voltage source and being controlled by said integrated circuit via said bus; and wherein one of said additional voltage levels is determined by said integrated circuit and sent to said voltage regulation module via said sense line.

2. The method according to claim 1, wherein said determined one of said additional voltage levels depends on a current operation mode of said integrated circuit.

3. The method according to claim 1, wherein said plurality of additional voltage levels are equidistant.

4. The method according to claim 1, wherein said plurality of additional voltage levels are programmed in said integrated circuit.

5. The method according to claim 1, wherein a feedback signal is sent to said voltage regulation module via said sense line.

6. The method according to claim 5, wherein said feedback signal is manipulated by a logic circuit within said integrated circuit.

7. The method according to claim 6, wherein said feedback signal is manipulated by a voltage divider within said integrated circuit.

8. An apparatus with an integrated circuit, comprising:

a voltage regulation module for supplying said integrated circuit with a supply voltage comprising a reference voltage and one of a plurality of additional voltage levels;

wherein said voltage regulation module and said integrated circuit are connected together via a sense line, a voltage supply line and a bus;

wherein said reference voltage is controlled by the integrated circuit via said bus;

wherein one of said plurality of additional voltage levels is sent to the voltage regulation module by said integrated circuit via said sense line; and wherein said sense line is formed as a feedback line.

9. The apparatus according to claim 8, wherein said integrated circuit includes at least one voltage mesh.

10. The apparatus according to claim 8, wherein said integrated circuit includes at least one voltage divider.

11. The apparatus according to claim 10, wherein the voltage divider is interconnected between the voltage mesh and a ground terminal of the integrated circuit.

12. The apparatus according to claim 10, wherein the voltage divider includes at least one of: (a) a plurality of resistor elements: and a plurality of transistor elements.

13. The apparatus according to claims 8, wherein said integrated circuit includes at least one resistor network.

14. The apparatus according claim 13, wherein said resistor network is programmable.

15. The apparatus according to claim 8, wherein said voltage regulation module includes at least one operational amplifier.

16. The apparatus according to claim 8, wherein said voltage regulation module includes at least one voltage source.

17. The apparatus according to claim 8, wherein said integrated circuit includes at least one control loop for detecting and controlling a voltage on the integrated circuit.

18. The apparatus according to claim 17, wherein said integrated circuit includes at least one voltage divider, and wherein said control loop is provided for controlling said voltage divider.

19. The method according to claim 1, wherein said method is implemented in hardware or a combination of hardware and software.

* * * * *